US011851880B2

(12) United States Patent
Rajkovic et al.

(10) Patent No.: US 11,851,880 B2
(45) Date of Patent: Dec. 26, 2023

(54) REINFORCING SPACER

(71) Applicant: Aus Chairs Pty Ltd, Liverpool (AU)

(72) Inventors: Bodin Rajkovic, Liverpool (AU); Francesco Iaconis, Liverpool (AU)

(73) Assignee: Aus Chairs Pty Ltd, Liverpool (AU)

( * ) Notice: Subject to any disclaimer, the term of this patent is extended or adjusted under 35 U.S.C. 154(b) by 0 days.

(21) Appl. No.: 17/045,501

(22) PCT Filed: Apr. 8, 2019

(86) PCT No.: PCT/AU2019/050310

§ 371 (c)(1),
(2) Date: Oct. 6, 2020

(87) PCT Pub. No.: WO2019/195880

PCT Pub. Date: Oct. 17, 2019

(65) Prior Publication Data

US 2021/0025168 A1 Jan. 28, 2021

(30) Foreign Application Priority Data

Apr. 8, 2018 (AU) ..... 2018902631
Jul. 18, 2018 (AU) ..... 2018206763

(51) Int. Cl.
*E04C 5/16* (2006.01)
*E04C 2/04* (2006.01)
(Continued)

(52) U.S. Cl.
CPC ..... *E04C 5/168* (2013.01); *E04C 2/044* (2013.01); *E04C 5/01* (2013.01)

(58) Field of Classification Search
CPC ... E04C 5/168; E04C 5/01; E04C 5/20; E04C 2/044
(Continued)

(56) References Cited

U.S. PATENT DOCUMENTS 1,148,643 A * 8/1915 Whittam et al. ..... E04B 1/2403 403/217
2,154,748 A * 4/1939 Hillberg ..... E04C 5/168 404/62
(Continued)

FOREIGN PATENT DOCUMENTS

AU 18033/92 A 12/1992
AU 126821 S 5/1996
(Continued)

*Primary Examiner* — Brian D Mattei
*Assistant Examiner* — Joseph J. Sadlon
(74) *Attorney, Agent, or Firm* — Thomas Joseph

(57) ABSTRACT

In a first aspect there is disclosed a reinforcing spacer (10) for use in constructing a concrete slab. The spacer (10) includes a first reinforcing arm (12) having a first arm base (16), a first arm wall (18) and a first arm support surface (20) provided on the first arm wall (18). The spacer (10) further includes a second reinforcing arm (14), transverse to the first reinforcing arm (12). The second reinforcing arm (14) has a second arm base (22), a second arm wall (24), and a second arm support surface (26) provided on the second arm wall (24). The first arm support surface (20) includes a first arm recess (36), and a first arm inclined surface (46) which slopes towards the first arm recess (36). The second arm support surface (20) includes a second arm recess (56) and a second arm inclined surface (60) which slopes towards the second arm recess (56). In use the spacer is located on a top surface of a pod to support a reinforcing mesh.

15 Claims, 3 Drawing Sheets

(51) Int. Cl.
*E04C 5/01* (2006.01)
*E04C 5/20* (2006.01)

(58) Field of Classification Search
USPC ..... 52/105
See application file for complete search history.

(56) References Cited

U.S. PATENT DOCUMENTS 3,672,022 A * 6/1972 York ..... B21F 27/005 428/116
3,830,032 A * 8/1974 Robb ..... E04C 5/206 52/687
3,863,414 A * 2/1975 Dunn, Jr. ..... E04C 5/03 52/659
3,918,222 A * 11/1975 Bahramian ..... E04B 5/06 52/301
4,150,475 A * 4/1979 Bondpers ..... E04C 5/0609 29/469
4,644,727 A * 2/1987 Hanson ..... E04C 5/20 52/678
4,682,461 A * 7/1987 Sizemore ..... E04C 5/20 52/677
4,689,867 A * 9/1987 Tolliver ..... E04C 5/18 249/91
4,744,190 A * 5/1988 Couwenbergs ..... E04C 5/18 52/649.8
4,996,816 A * 3/1991 Wiebe ..... E04C 5/18 52/686
5,283,996 A * 2/1994 Myers ..... B28B 23/04 249/93
5,421,136 A * 6/1995 Van De Peer ..... E02D 27/08 52/294
5,626,436 A * 5/1997 Dragone ..... E04C 5/167 24/339
5,992,123 A * 11/1999 Kies ..... E04C 5/0645 52/719
6,282,860 B1 * 9/2001 Ramirez ..... E04C 5/203 52/686
6,598,364 B1 * 7/2003 Pelles ..... E01C 11/126 52/396.04
6,789,366 B1 * 9/2004 Febra ..... B28B 23/0068 52/576
7,121,053 B2 * 10/2006 Toncelli ..... B28B 1/082 52/649.1
7,191,572 B2 * 3/2007 Izquierdo ..... E04G 17/0658 52/699
7,997,041 B2 * 8/2011 Slack ..... B01D 24/4631 52/592.1
8,099,925 B1 * 1/2012 Coons ..... E04C 5/20 404/136
8,161,698 B2 * 4/2012 Migliore ..... E02D 27/42 52/649.4
9,297,163 B2 * 3/2016 Golledge ..... E04C 5/167
9,359,764 B2 * 6/2016 Andersson ..... E04C 5/168
9,366,026 B1 * 6/2016 Medina ..... E04B 2/60
10,066,404 B2 * 9/2018 Parodi ..... E04G 11/46
10,584,487 B2 * 3/2020 Caboni ..... E04B 5/38
10,753,088 B2 * 8/2020 Mirkhani ..... E04B 7/00
11,286,667 B2 * 3/2022 Giles ..... E04C 5/0604
2004/0093824 A1 * 5/2004 Huber ..... E04C 5/205 52/834
2004/0216415 A1 * 11/2004 Pfeiffer ..... E04C 5/06 52/782.1
2006/0188335 A1 * 8/2006 Harris ..... E01C 11/18 404/136
2013/0036693 A1 * 2/2013 Lee ..... E04C 5/163 264/261
2014/0102020 A1 * 4/2014 Fradera Pellicer ..... B28B 23/0056 52/223.6
2016/0115698 A1 4/2016 Parodi
2017/0114541 A1 * 4/2017 Hebel ..... B27N 3/00
2017/0233999 A1 * 8/2017 Gilman ..... E04B 1/41 248/542
2019/0136389 A1 * 5/2019 Kim ..... C23F 13/18

FOREIGN PATENT DOCUMENTS

AU 2006213953 A1 4/2008
AU 2007201886 A1 11/2008
AU 2009206168 A1 2/2010
AU 2010100447 A4 6/2010
AU 332888 S 9/2010
AU 343122 S 6/2012
AU 346524 S 1/2013
AU 2013200085 A1 7/2013
AU 2011101760 A4 8/2015
AU 2016200822 A1 * 2/2016
AU 2016200822 B2 2/2016
AU 2017200335 A1 2/2017
AU 200157850 A1 2/2020
DE 4134440 A1 * 4/1993 ..... E04C 5/168
KR 101322581 B1 * 10/2013 ..... E04C 5/168
WO 2009/029994 A1 3/2009

* cited by examiner

REINFORCING SPACER

CROSS REFERENCE TO RELATED APPLICATIONS

The present application is a U.S. national stage application of PCT International Application No. PCT/AU2019/050310, filed Apr. 8, 2019, and published as PCT Publication WO/2019/195880 on Oct. 17, 2019, which claims priority to Australian Application No. AU 2018206763, filed on Jul. 18, 2018 and to Australian Application No. AU 2018902631, filed on Apr. 8, 2018. The disclosures of all the foregoing applications are hereby incorporated by reference in their entirety into the present application.

FIELD

The invention concerns a reinforcing spacer. In one particular, but non-exclusive, aspect the invention concerns a reinforcing spacer for use in (i) positioning waffle pods during concrete slab construction, and (ii) supporting metal reinforcing during concrete pour.

BACKGROUND

A waffle pod slab system is a method of constructing concrete slabs which provides strength and durability while reducing building costs. Built above the ground, rather than in the ground, a waffle pod slab foundation eliminates labour intensive trenching. Waffle pod slabs include spaced-apart blocks, typically produced from polystyrene, which are placed in a grid formation. Such polystyrene blocks are commonly referred to as "waffle pods" because they are hollow with a "waffle"-like internal bracing. Waffle pods provide a lightweight void former for concrete slabs. They aid in the speed of construction and reduce the cost of construction as less concrete is required during a pour.

To construct a concrete slab employing waffle pods a building site is flattened and the plumbing laid. Edge boards providing a peripheral formwork is erected to define an outer periphery of a floor. The enclosed area is hereafter covered with plastic sheeting. Pods can now be placed inside the peripheral formwork to form an outer trench between the pods and the formwork. Working from one corner, further pods are positioned in a grid pattern within the formwork. Plastic spacers are located at the intersection of gaps between pods whereafter reinforcement bars are positioned on the spacers. A single reinforcing bar is typically used between pods crossing at the intersection of gaps between pods while three or more spaced reinforcing bars are placed in the outer trench. A reinforcing mesh is laid on top of the pods, whereafter a concreter and steel fixer will manually lift the reinforcing mesh to insert plastic spacers, referred to as chairs, between the mesh and a top surface of the pods. The spacers ensure there is a gap between the top of the pods and the mesh. That gap will be filled with concrete during concrete pour.

With the pods and reinforcing in position concrete is poured over and around the pods. The concrete will flow into the gaps between the pods and into the outer trench. Finally, the concrete is vibrated to ensure that all gaps are filled and a specified amount of concrete covers the pods and the reinforcing mesh located on top of the pods.

One drawback of placing reinforcing chairs in position on waffle pods is that it is a labour-intensive process. Typically, a concreter will first drop the reinforcing mesh on top of the pods and thereafter manually lift the mesh to place four chairs on each pod. This can be physically demanding and consume a large amount of time to complete, particularly when the size of the slab being constructed is relatively large.

Object

It is an object of the present invention to provide an alternative reinforcing spacer which ameliorates the amount of labour required for locating reinforcing mesh within reinforcing spacers, or to provide a useful alternative reinforcing spacer.

SUMMARY

According to a first aspect of the present invention there is disclosed herein a reinforcing spacer for use in constructing a concrete slab, the spacer including:

a first reinforcing arm, the first reinforcing arm having a (i) first arm base, (ii) a first arm wall, and (iii) a first arm support surface provided on the first arm wall; and a second reinforcing arm, transverse to the first reinforcing arm, the second reinforcing arm having (i) a second arm base, (ii) a second arm wall, and (iii) a second arm support surface provided on the second arm wall, wherein (i) the first arm support surface includes (a) a first arm recess, and (b) a first arm inclined surface which slopes towards the first arm recess, and (ii) the second arm support surface includes (a) a second arm recess, and (b) a second arm inclined surface which slopes towards the second arm recess, so that when the spacer is located on a top surface of a pod, (i) the first arm inclined surface is operatively adapted to guide a first elongate member of a reinforcing mesh into the first arm recess, and (ii) the second arm inclined surface is operatively adapted to guide a transverse second elongate member of the reinforcing mesh into the second arm recess.

Preferably the first arm wall and the second arm wall define a first holding position and a second holding position so that when a portion of a first pod is located within the first holding position and a portion of a second pod is located within the second holding position the first arm wall and the second arm wall are adapted to maintain the first pod and second pod in a spaced-apart relationship.

Preferably the first arm base and first arm wall each includes at least one flow opening to permit concrete to flow therethrough.

Preferably the first arm base and the first arm wall each includes a plurality of flow openings to permit concrete to flow therethrough.

Preferably the second arm base and second arm wall each includes at least one flow opening to permit concrete to flow therethrough.

Preferably the second arm base and the second arm wall each includes a plurality of flow openings to permit concrete to flow therethrough.

Preferably the first arm includes at least one transverse first arm cross wall.

Preferably the first arm cross wall includes a first cross wall recess.

Preferably the first arm recess is in register with the first cross wall recess.

Preferably the first arm includes a plurality of first arm cross walls.

Preferably the second arm includes at least one transverse second arm cross wall.

Preferably the second arm cross wall includes a second cross wall recess.

Preferably the second arm recess is in register with the second cross wall recess.

Preferably the second arm includes a plurality of second arm cross walls.

Preferably the first arm wall tapers inwardly from the first arm support surface to the first arm base.

Preferably the second arm wall tapers inwardly from the second arm support surface to the second arm base.

Preferably the first arm includes two outer first arm units, each outer first arm unit including a portion of the first arm base, a portion of the first arm wall and a first arm cross wall.

Preferably the second arm includes two outer second arm units, each second arm unit including a portion of the second arm base, a portion of the second arm wall and a second arm cross wall.

Preferably the first arm includes a central arm unit located between the outer first arm units.

Preferably the second arm includes a central arm unit located between the outer second arm units.

Preferably the central arm unit of the first arm is the central arm unit of the second arm.

Preferably the reinforcing spacer includes measurement markings.

BRIEF DESCRIPTION OF THE DRAWINGS

Preferred embodiments of the invention will be described hereinafter, by way of examples only, with reference to the accompany drawings, wherein.

DESCRIPTION OF PREFERRED EMBODIMENTS

Figure 1:
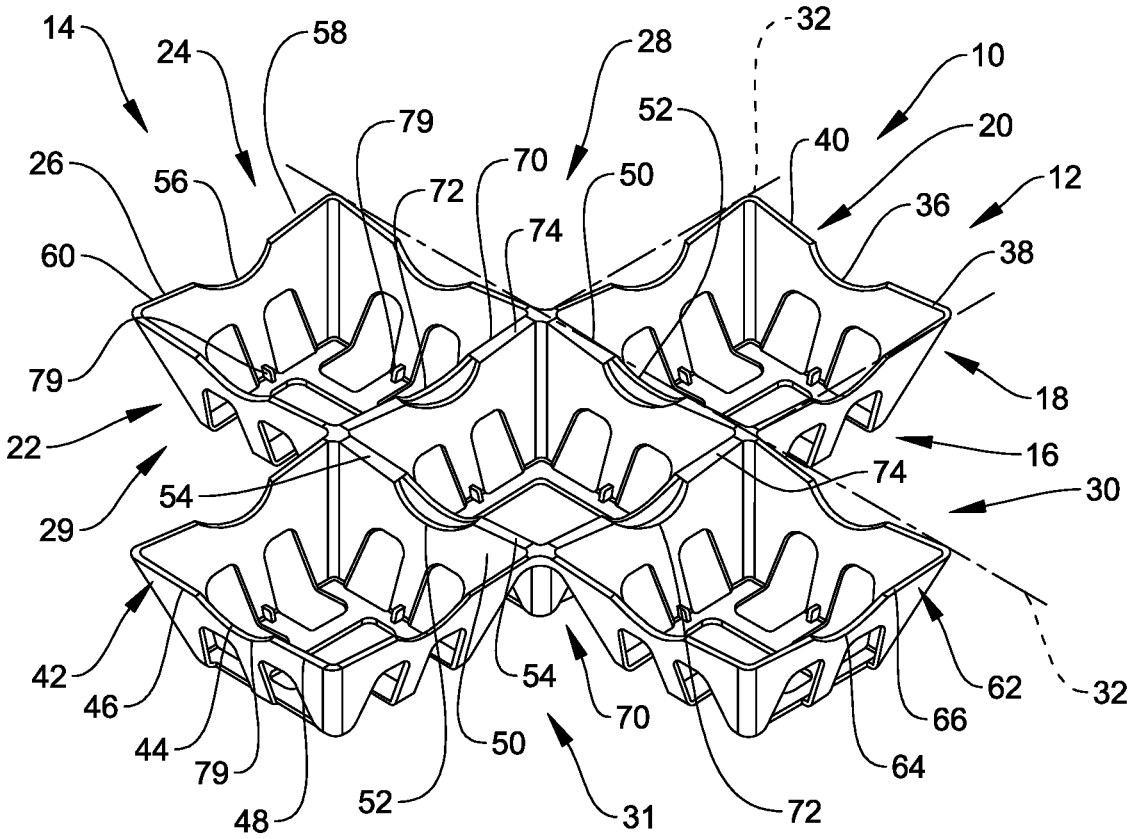
FIG. 1 is a schematic perspective view of an embodiment reinforcing spacer.

FIGS. 1 to 4 show an embodiment reinforcing spacer, generally indicated with the reference numeral 10, for use in constructing a non-illustrated concrete slab. The spacer 10 includes a first reinforcing arm 12 and a second reinforcing arm 14 transversely oriented relative to the first reinforcing arm 12.

The first reinforcing arm 12 has a substantially flat first arm base 16, a circumferential first arm wall 18 and a first arm support surface 20 provided on the first arm wall 18. The second reinforcing arm 14 has a substantially flat second arm base 22, a circumferential second arm wall 24 and a second arm support surface 26 provided on the second arm wall 24. The first arm wall 18 and second arm wall 24 define a first holding position 28 and a second holding position 30. The first holding position 28 and second holding position 30 in effect provide two corners for operatively abutting portions of a first and second waffle pod 32, 34. When a portion of the first pod 32 is located within the first holding position 28 and a portion of the second pod 34 is located within the second holding position 30, the first arm wall 18 and second arm wall 24 are adapted to maintain the first pod 32 and second pod 34 in a spaced-apart relationship, in this embodiment 110 mm. In this embodiment the first and second reinforcing arms 12, 14 define third and fourth holdings positions 29, 31 for respectively holding a non-illustrated third and fourth waffle pod. As with the first and second holding positions 28, 30 the third and fourth holding positions 29, 31 provide corners which are in use abutted by the non-illustrated third and fourth pods.

The first arm support surface 20 includes a first arm recess 36 and a first arm inclined surface 38 which slopes towards the first arm recess 36. The first arm support surface 20 includes an opposing inclined surface 40. The first arm recess 36 is located at the centre of the first arm support surface 20 and between the first arm surface 38 and the inclined surface 40. At an opposite end of the first reinforcing arm 12 another first arm support surface 42 is provided which includes another first arm recess 44 and another first arm inclined surface 46 which slopes towards the other first arm recess 44. The other first arm support surface 42 includes an opposing inclined surface 48. The other first arm recess 44 is located at the centre of the other first arm support surface 42 and between the inclined surfaces 46, 48. The first arm recess 36 is in register with the other first arm recess 44.

The first arm 12 includes two transverse first arm cross walls 50. Each first arm cross wall 50 includes a first cross wall recess 52 located at the centre of its respective first arm cross wall 50. The first arm recesses 36, 44 are in register with the first cross wall recesses 52. The transverse first arm cross walls 50 include inclined surfaces 54 configured similar to the inclined surfaces 38, 46.

The second arm support surface 26 includes a second arm recess 56 and a second arm inclined surface 58 which slopes towards the second arm recess 56. The second support surface 26 includes an opposing inclined surface 60. The second arm recess 56 is located at the centre of the second arm support surface 20 and between the inclined surfaces 58, 60. At an opposite end of the second reinforcing arm 14 another second arm support surface 62 is provided which includes another second arm recess 64 and another second arm inclined surface 66 which slopes towards the other second arm recess 64. The other second support surface 62 includes an opposing inclined surface 68. The other second arm recess 64 is located at the centre of the other second arm support surface 62 and between the inclined surfaces 66, 68. The second arm recess 56 is in register with the other second arm recess 64.

The second arm 14 further includes two transverse second arm cross walls 70. Each second arm cross wall 70 includes a second cross wall recess 72 located at the centre of its respective second arm cross wall 70. The second arm recesses 56, 64 are in register with the second cross wall recesses 72. The transverse second arm cross walls 70 include inclined surfaces 74 configured similar to the inclined surfaces 38, 46.

Figure 2:
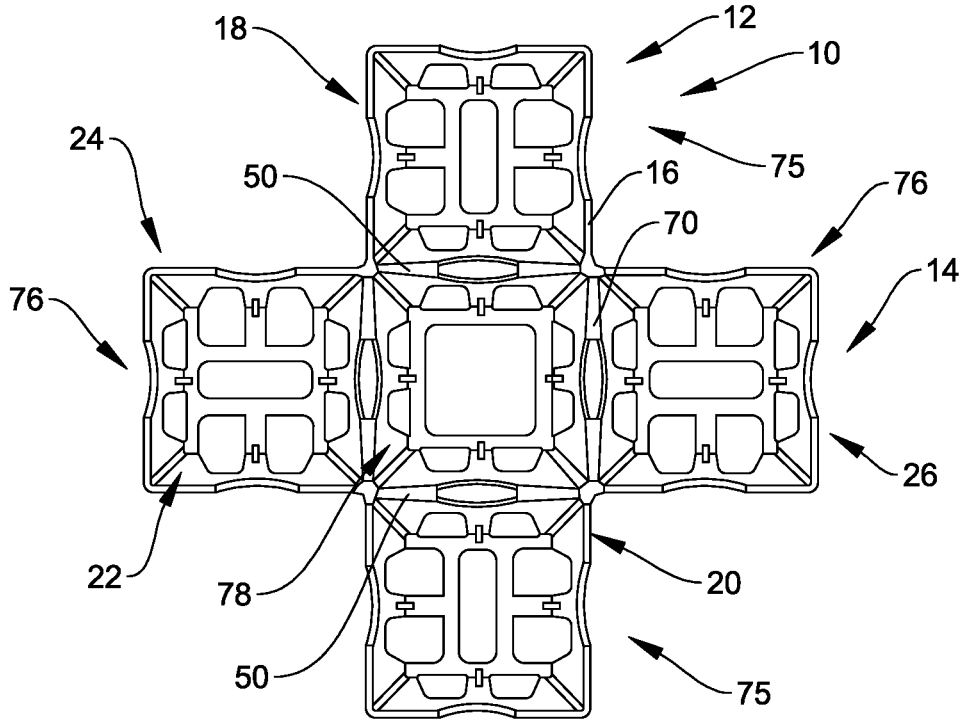
FIG. 2 is a schematic top view of the reinforcing spacer of FIG. 1.
Figure 3:
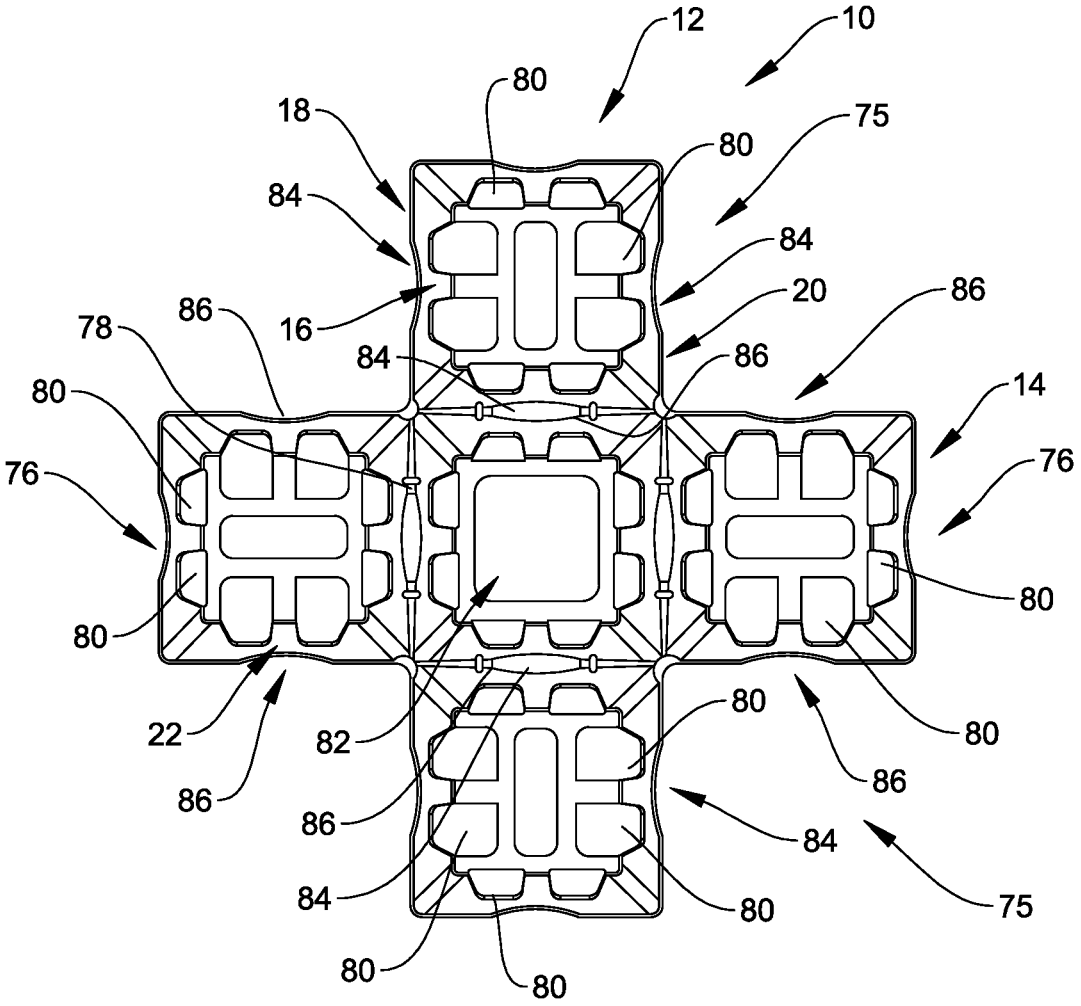
FIG. 3 is a schematic bottom view of a reinforcing spacer of FIG. 1.

The effect of having the transverse cross walls 50, 70 in the first and second reinforcing arms 12, 14 is that the first arm 12 includes two outer first arm units 74 and the second arm 14 includes two outer second arm units 76, shown in FIGS. 2 and 3. The outer first arm units 74 each includes a portion of the first arm base 16, a portion of the first arm wall 18 and a first arm cross wall 50. The outer second arm units 76, in turn, each includes a portion of the second arm base 22, a portion of the second arm wall 18 and a second arm cross wall 70. The first reinforcing arm 12 includes a central arm unit 78 located between the outer first arm units 74. The central arm unit 78 is also located between the outer second arm units 76 of the second reinforcing arm 14. The central arm unit 78 is thus common to both the first and second reinforcing arms 12, 14 and will bear most of the weight of reinforcing being supported. The reinforcing spacer 10 includes strengthening ribs 79 dispersed respectively between the first arm base 16 and first arm wall 18 and the second arm base 22 and second arm wall 24 respectively to support the first and second arm walls 18, 24 when supporting reinforcing.

Referring to FIG. 3, the first arm base 16 and first arm wall 18 each includes a plurality of flow openings 80 to permit concrete to flow therethrough. Similarly, the second arm base 22 and second arm wall 24 each includes a plurality of flow openings 82 to permit concrete to flow therethrough. The central arm unit 78 includes a large substantially square central opening 82 to facilitate concrete flow.

Each of the outer first arm units 74 and central arm unit 78 includes a pair of in-register first arm cross recesses 84. Similarly, each of the outer second arm units 76 and central arm unit 78 includes a pair of in-register second arm cross recesses 86.

Figure 4:
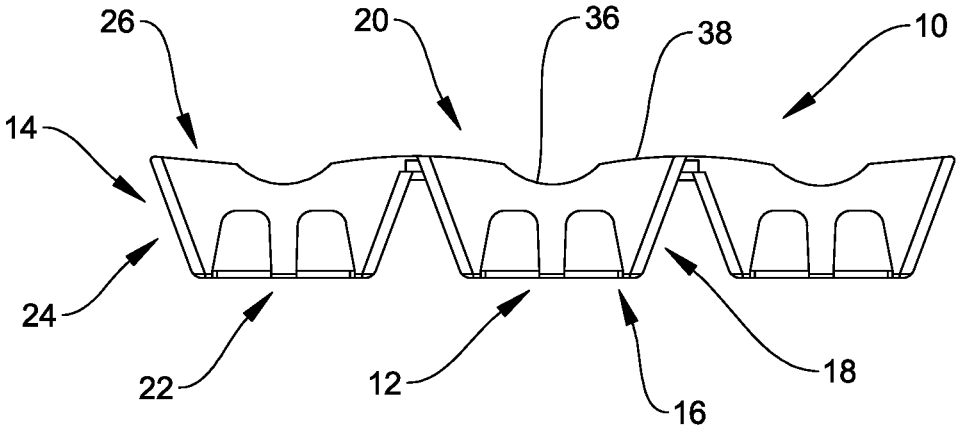
FIG. 4 is a schematic side view of the reinforcing spacer of FIG. 1.

Referring to FIG. 4, the first arm wall 18 tapers inwardly from the first arm support surface 20 to the first arm base 16. The second arm wall 24, in turn, tapers inwardly from the second arm support surface 20 to the second arm base 22.

Figure 5:
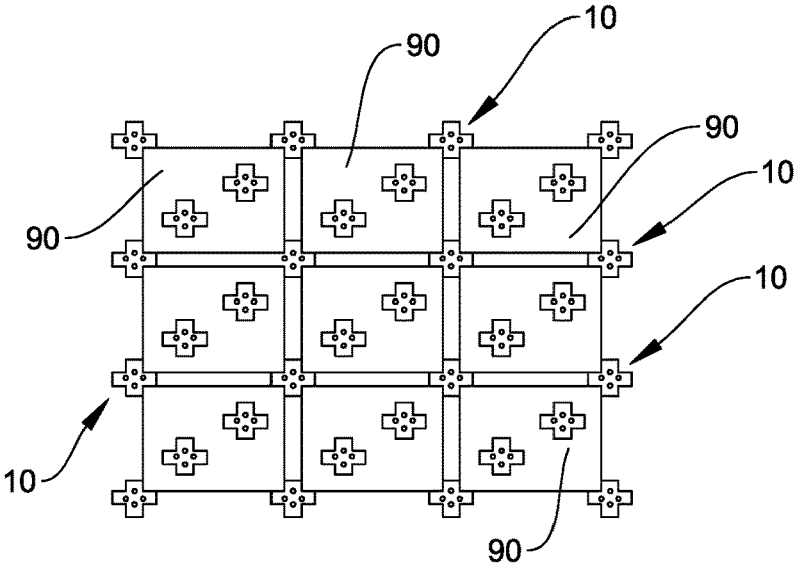
FIG. 5 is a schematic top view of a plurality of reinforcing spacers employed to hold a plurality of waffle pods.

Referring to FIG. 5, in one application a plurality of embodiment reinforcing spacers 10 can be employed to maintain a plurality of waffle pods 90 in a grid pattern. In this application the first arm recesses 36, 44, first arm cross wall recesses 52, and first arm cross recesses 84, are able to hold a portion of an elongate reinforcing member in parallel with two elongate reinforcing members respectively held within the first arm cross recesses 84 of the outer first arm units 74. Similarly, the second arm recesses 56, 64, second arm cross wall recesses 72, and second arm cross recesses 86, are able to hold a portion of an elongate reinforcing member in parallel with two elongate reinforcing members respectively held within the second arm cross recesses 86 of the outer second arm units 76. In this application the reinforcing spacer 10 can hold reinforcing bars in parallel or hold trench mesh.

FIG. 5 also shows each waffle pod 90 having two embodiment reinforcing spaces 10 located on their top surfaces. In this application the reinforcing spacers 10 are adapted to hold elongate portions of a reinforcing mesh laid on top of the waffle pods 90. The various inclined surfaces 38, 40, 46, 48, 58, 60, 66, 68 are operatively adapted to guide the reinforcing to be located within the various recesses 36, 44, 52, 56, 64, 72, 84, 86 of the reinforcing spacer 10. This eliminates the need to manually locate reinforcing mesh within those recesses as the concreter can first place the reinforcing spacers 10 on top of the waffle pods 90 and then drop the reinforcing mesh on top of the waffle pods 90 and have the inclined surfaces guide the mesh into the relevant recesses under the influence of gravity. In effect this eliminates the current practice of having to bend and place a chair in position after the reinforcing has been dropped onto the waffle pods. By employing the embodiment reinforcing spacer 10, a concreter need only employ a single spacer and not two different types of spacers/chairs for the trench bars/trench reinforcing and the reinforcing mesh laid on top of waffle pods. The embodiment reinforcing spacer 10 is adapted to support N11, N12, N16 and N20 steel bar sizes.

Figure 6:
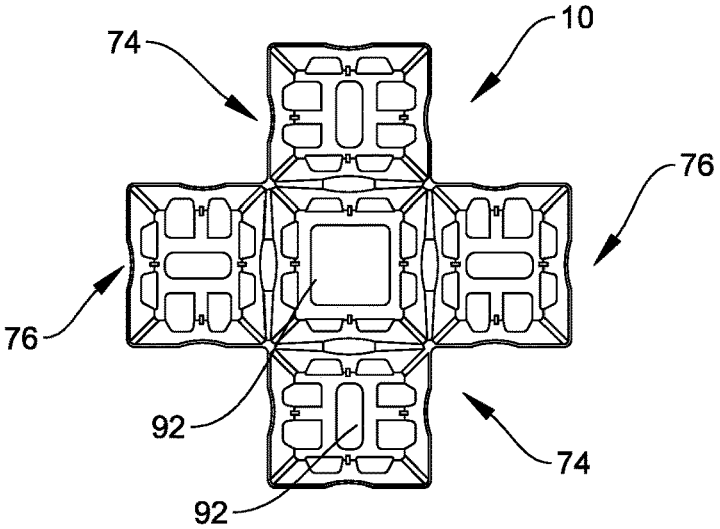
FIG. 6 is a schematic top view of the reinforcing spacer of FIG. 1 showing measurements.
Figure 7:
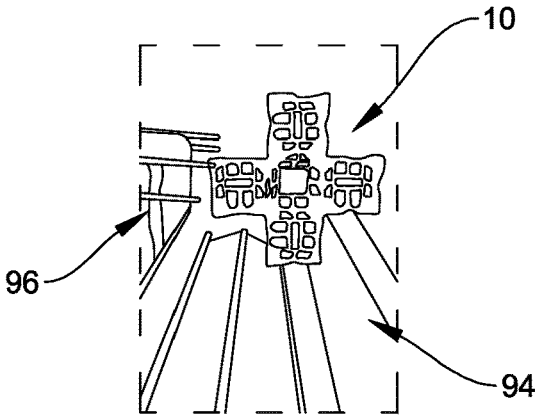
FIG. 7 is a schematic perspective view of the reinforcing spacer employed for measuring a distance.

Referring to FIG. 6, reinforcing spacer 10 includes measurement markings 92 so that the reinforcing spacer 10 can be employed as a measurement rebate tool. As shown, the embodiment reinforcing spacer 10 has a width of 300 mm and a length of 300 mm. Each of the outer first arm units 74, outer second arm units 76, and central arm unit 78 has a width of 110 mm. By locating the reinforcing spacer 10 on an edge formwork 94 proximate where a rebate is to be created, a concreter can get an accurate indication of the positioning of the mesh 96 to ensure the mesh 96 is covered with a sufficient amount of concrete to deter concrete cancer. In the present instance the reinforcing spacer 10 can be employed to ensure that a reinforcing mesh is encased with 50 mm of concrete.

The embodiment reinforcing spacer 10 is produced from a polymer, but it will be appreciated that a range of materials could be employed to produce the reinforcing spacer. In the present embodiment the reinforcing spacer 10 is produced from a plastic having a 2 mm thickness.

By having a substantially flat first arm base 16 and a substantially flat second arm base 22 poured concrete will enable the reinforcing spacer 10 to be firmly grounded with no or very minimal movement lateral movement. The flat first and second arm bases 16, 22 further ensure that when a reinforcing spacer 10 is placed on a flat top surface of a waffle pod, the reinforcing spacer will stand firmly.

Although the invention has been described with reference to specific examples, it will be appreciated by those skilled in the art that the invention may be embodied in many other forms.

The invention claimed is:

1. A reinforcing spacer for use in constructing a concrete slab, the reinforcing spacer including:

a first arm that is a first reinforcing arm, the first reinforcing arm having (i) a planar first arm base including at least one flow opening, (ii) a first arm wall provided on the first arm base, and (iii) a first arm support surface provided on the first arm wall; and a second arm that is a second reinforcing arm and that is transverse to the first arm, the second reinforcing arm having (i) a planar second arm base including at least one flow opening, (ii) a second arm wall provided on the second arm base, and (iii) a second arm support surface provided on the second arm wall, wherein (i) the first arm support surface includes (a) a first arm recess, and (b) a first arm inclined surface which slopes towards the first arm recess, and (ii) the second arm support surface includes (a) a second arm recess, and (b) a second arm inclined surface which slopes towards the second arm recess, wherein the first reinforcing arm includes two first arm cross walls, each first arm cross wall including a first cross wall recess, the first cross wall recesses being in register with the first arm recess, wherein, (i) the first arm inclined surface is operatively adapted to guide a first elongate reinforcing member into the first arm recess, and (ii) the second arm inclined surface is operatively adapted to guide a transverse second elongate reinforcing member into the second arm recess, wherein the first reinforcing arm provides two outer first arm container units, each outer first arm container unit (i) including a portion of the first arm base, a portion of the first arm wall and a first arm cross wall, and (ii) having a first planar base, an opposing open top and side walls tapering outwardly from the first planar base, wherein the second reinforcing arm provides two outer second arm container units, each second arm unit (i) including a portion of the second arm base, a portion of the second arm wall and a second arm cross wall, and (ii) having a second planar base, an opposing open top and side walls tapering outwardly from the second planar base, wherein the first reinforcing arm includes a central arm container unit located between the two outer first arm container units, the central arm container unit having a central planar base, an opposing open top and side wall tapering outwardly from the central bases, wherein the second reinforcing arm includes the central arm container unit, the central arm container unit being located between the two outer second arm units, and wherein the first arm wall and the second arm wall define a first holding position and a second holding position so that when a portion of a first pod is located within the first holding position and a portion of a second pod is located within the second holding position the first arm wall and the second arm wall are adapted to maintain the first pod and second pod in a spaced-apart relationship.

2. A reinforcing spacer according to claim 1, wherein the first arm base and first arm wall each includes at least one flow opening to permit concrete to flow therethrough.

3. A reinforcing spacer according to claim 2, wherein the first arm base and the first arm wall each includes a plurality of flow openings to permit concrete to flow therethrough.

4. A reinforcing spacer according to claim 1, wherein the second arm base and second arm wall each includes at least one flow opening to permit concrete to flow therethrough.

5. A reinforcing spacer according to claim 4, wherein the second arm base and the second arm wall each includes a plurality of flow openings to permit concrete to flow therethrough.

6. A reinforcing spacer according to claim 1, wherein the second reinforcing arm includes at least one transverse second arm cross wall.

7. A reinforcing spacer according to claim 6, wherein the second arm cross wall includes a second cross wall recess.

8. A reinforcing spacer according to claim 7, wherein the second arm recess is in register with the second cross wall recess.

9. A reinforcing spacer according to claim 8, wherein the second reinforcing arm includes a plurality of second arm cross walls.

10. A reinforcing spacer according to claim 1, wherein the first arm wall tapers inwardly from the first arm support surface to the first arm base.

11. A reinforcing spacer according to claim 10, wherein the second arm wall tapers inwardly from the second arm support surface to the second arm base.

12. A reinforcing spacer according to claim 11, wherein the first reinforcing arm includes two outer first arm units, each outer first arm unit including a portion of the first arm base, a portion of the first arm wall and a first arm cross wall.

13. A reinforcing spacer according to claim 12, wherein the second reinforcing arm includes two outer second arm units, each second arm unit including a portion of the second arm base, a portion of the second arm wall and a second arm cross wall.

14. A reinforcing spacer according to claim 1, wherein the first reinforcing arm includes a central arm unit located between two outer first arm units.

15. A reinforcing spacer according to claim 1, wherein the second reinforcing arm includes a central arm unit located between two outer second arm units.

* * * * *